US005511105A

United States Patent [19]

Knott

[11] Patent Number: 5,511,105

[45] Date of Patent: Apr. 23, 1996

[54] X-RAY TUBE WITH MULTIPLE DIFFERENTLY SIZED FOCAL SPOTS AND METHOD FOR OPERATING SAME

[75] Inventor: Willibald Knott, Eckental, Germany

[73] Assignee: Siemens Aktiengesellschaft, Munich, Germany

[21] Appl. No.: 205,249

[22] Filed: Mar. 3, 1994

[30] Foreign Application Priority Data

Jul. 12, 1993 [DE] Germany ..... 43 23 298.1

[51] Int. Cl.[6] ..... H01J 35/06

[52] U.S. Cl. ..... 378/134; 378/125; 378/138

[58] Field of Search ..... 378/119, 124, 378/134, 143, 144, 145, 138

[56] References Cited

U.S. PATENT DOCUMENTS

| | | | |
|---|---|---|---|
| 2,942,126 | 6/1960 | Silbermann | 378/134 |
| 3,610,984 | 10/1971 | Seki | 378/134 |
| 4,287,420 | 9/1981 | Yamamura et al. | 378/41 |
| 4,712,226 | 12/1987 | Horbaschek | 378/134 |
| 5,303,281 | 4/1994 | Koller et al. | 378/134 |

FOREIGN PATENT DOCUMENTS

| | | |
|---|---|---|
| 0322260 | 11/1988 | European Pat. Off. . |
| 2231970 | 8/1973 | Germany . |
| 2727907 | 1/1979 | Germany . |
| 2943700 | 12/1982 | Germany . |
| 3840398A1 | 6/1989 | Germany . |

*Primary Examiner*—David P. Porta
*Assistant Examiner*—Don Wong
*Attorney, Agent, or Firm*—Hill, Steadman & Simpson

[57] ABSTRACT

An x-ray tube has an anode whose target area is divided into regions formed of different materials, whereby focal spots of different size can be optionally generated in each of the regions. The focal spots belonging to one region are respectively generated at different locations but all focal spots are generated so close together that the focal position is essentially the same for all focal spots. An operating method for such an x-ray tube is also disclosed.

14 Claims, 2 Drawing Sheets

X-RAY TUBE WITH MULTIPLE DIFFERENTLY SIZED FOCAL SPOTS AND METHOD FOR OPERATING SAME

BACKGROUND OF THE INVENTION

1. Field of the Invention

The present invention is directed to an x-ray tube of the type having an anode whose target area is divided into regions formed of different materials, and having an electron emitter with which at least one focal spot can be generated in each of the regions, so that a plurality of focal spots of different sizes can be generated in at least one region, and to a method for operating such an x-ray tube.

2. Description of the Prior Art

X-ray tubes of the type generally described above are employed, for example, in mammography. The different materials are selected such that x-radiation having different hardnesses can be generated, whereby softer radiation is employed for breasts having a low or medium density and harder radiation is employed for breasts having high density. Moreover, a larger focal spot is employed for normal demands and magnification factors, since this can be more highly loaded and, thus, enables shorter exposure times. A smaller focal spot is employed in case of special demands made on the resolution of the exposures and/or given a need for high magnification factors.

An x-ray tube of the type initially cited is described in a company publication of Machlett dated 1986. This known x-ray tube has a target area divided into two regions formed of different materials, whereby a larger and a smaller focal spot can be generated in each of the regions. This known x-ray tube has two radiation exit windows arranged lying diametrically opposite one another, the exit windows being respectively allocated to the two regions of the anode. This known arrangement has the disadvantage that the x-ray tube must be installed in an x-ray diagnostics apparatus so as to be rotatable by 180°, so that the one or the other radiation exit window can be optionally brought into the position suitable for the production of an x-ray exposure, dependent upon which of the two regions of the target area is to be employed. This requires a high structural and financial outlay.

European Application 0 322 260 also discloses an x-ray tube whose target area is divided into two regions formed of different materials, whereby one focal spot can be generated in each of the regions. The focal position is essentially the same for both focal spots, so that it is possible to use both regions without adjustment of the x-ray tube. Since only one focal spot can be generated in each of the two regions, only one focal spot size is available per region.

German OS 22 31 970 discloses an x-ray tube whose target area is composed entirely of the same material. A smaller or a larger focal spot can be optionally generated at the same location in this x-ray tube. Both focal spots lie at the same location.

German PS 29 43 700 discloses an x-ray tube for stereo exposures whose target is likewise entirely composed of the same material. In this x-ray tube, two focal spot pairs having respectively different focal spot spacing are provided, whereby the focal spot pairs have different focal spot sizes. A fifth focal spot that is centrally arranged with respect to the two focal spot pairs is provided for normal exposures. It is indispensable for the proper functioning of this x-ray tube that the focal position of all focal spots be different.

SUMMARY OF THE INVENTION

It is an object of the present invention to provide an x-ray tube of the type initially described wherein it is possible to use regions of the target area composed of different materials without adjustment of the x-ray tube and such that focal spots of different sizes are nonetheless available in at least one of the regions.

This object is inventively achieved in an x-ray tube and operating method wherein an anode target area is divided into regions formed of different materials, and an electron emitter generates at least one focal spot in each of the regions, whereby a plurality of focal spots can be generated in at least the region, and focal spots of different sizes can be generated in at least the region wherein a plurality of focal spots can be generated, and wherein the focal spots belonging to the different regions, as well as the focal spots of different sizes belonging to one region, are generated at different locations but nonetheless lie so closely to one another that the focal position is essentially the same for all focal spots. It is thereby guaranteed that the same beam exit window can be employed for all regions of the target area and for all focal spots. As a result of the measure that the focal spots of different sizes belonging to one region of the target lie at respectively different locations, the larger focal spots cannot be "spoiled" by the smaller focal spots. As a consequence of what a higher thermal loading of the smaller focal spots, damage to the target tends to occur at those smaller focal spots; in the x-ray tube of the invention, however, this has no influence on the larger focal spots.

In a preferred embodiment of the invention the anode is fashioned as a rotating anode and the focal spots lie on respectively different radii of the rotating anode. It is especially advantageous in the case of a rotating anode to make the focal spots lie on a straight line at least approximately intersecting the circumferential direction (tangent) of the rotating anode, since an arrangement of the focal spots that lies maximally close to one another is thus enabled for the case of a straight line that at least essentially proceeds radially.

In a further version of the invention, at least one large and at least one small focal spot can be respectively generated in two of the regions, whereby two large focal spots lying in different regions are immediately adjacent to one another. This results in the focal position for the large focal spots (which are normally employed) being practically identical.

The anode can be divided into two regions formed of different materials, and a common beam exit window is provided for all focal spots.

DESCRIPTION OF THE PREFERRED EMBODIMENTS

Figure 1:
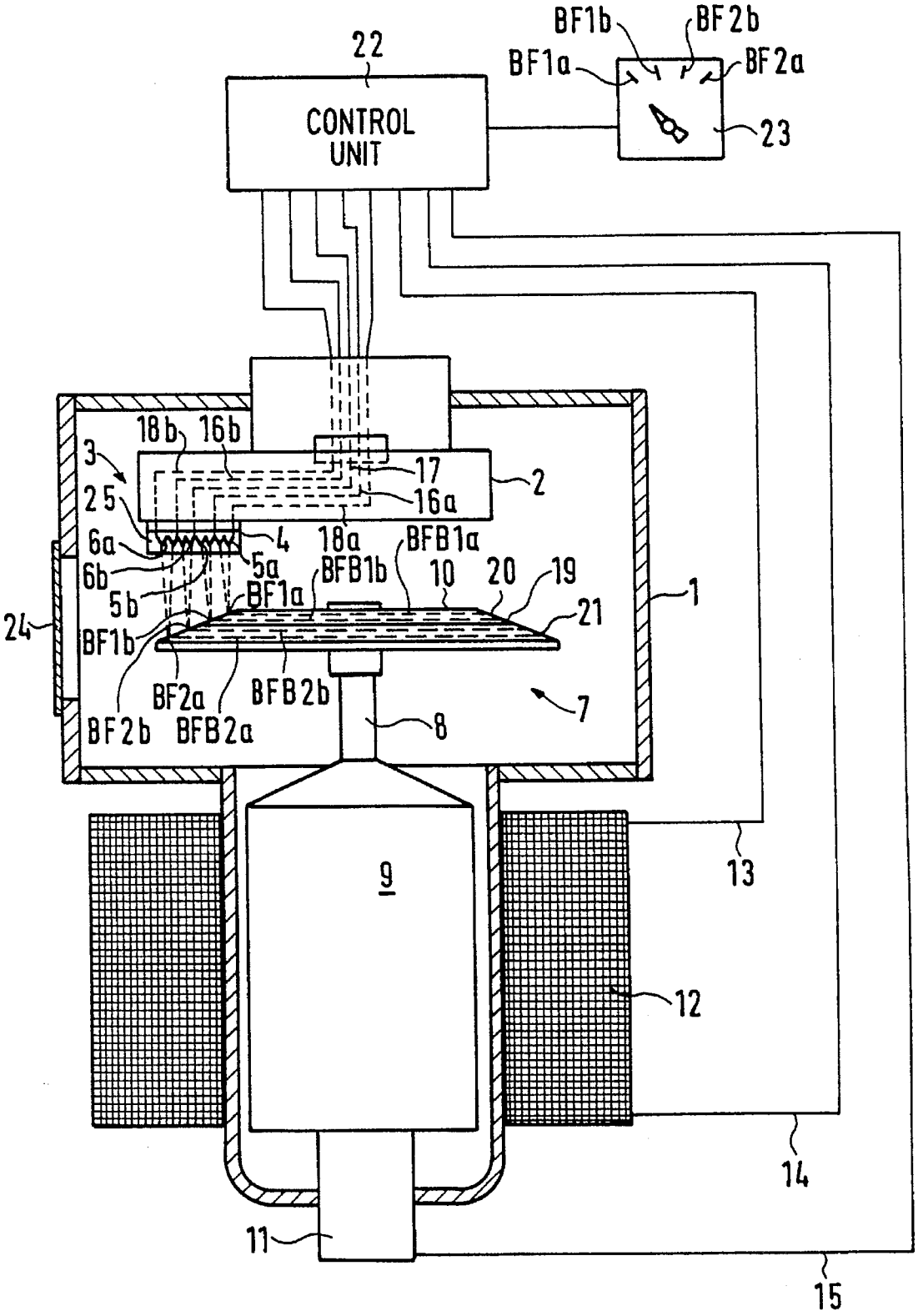
FIG. 1 is a schematic illustration of a longitudinal section through an x-ray tube constructed and operating in accordance with the principles of the present invention.
Figure 2:
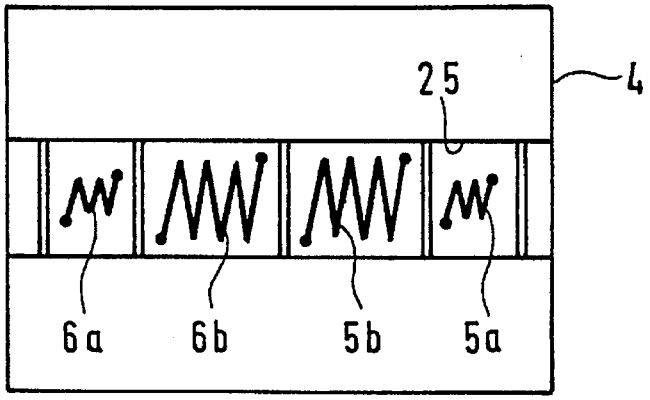
FIG. 2 is a front view of the cathode arrangement of the x-ray tube of FIG. 1.

In FIG. 1, the bulb of the x-ray tube is referenced 1, this being manufactured in the described exemplary embodiment of metal and ceramic in a known way, although other materials are possible. A cathode arrangement 3 is attached to a carrier part 2 within the bulb 1. The cathode arrangement 3 has a total of four incandescent cathodes 5*a* and 5*b* as well as 6*a* and 6*b* in a common concentration cup 4. A rotating anode arrangement generally referenced 7 is provided opposite the incandescent cathodes 5*a*, 5*b*, 6*a* and 6*b*. The rotating anode arrangement 7 includes an anode dish 10 connected to a rotor 9 via a shaft 8. The rotor is rotatably seated (in a known manner, not shown in FIG. 1) on a shaft 11 connected to the bulb 1. A stator 12 that interacts with the rotor 9 to form of an electric motor serving the purpose of driving the rotating anode is put in place on the outside wall of the bulb 1 in the region of the rotor 9.

During operation of the x-ray tube, an alternating current is supplied to the stator 12 via lines 13 and 14, so that the anode dish 10 connected to the rotor 9 via the shaft 11 rotates. The tube voltage is applied via lines 15 and 16*a*, or via lines 15 and 16*b*, whereby the line 16*a* is connected to one terminal of the incandescent cathodes 5*a* and 5*b* and the line 16*b* is connected to one of the terminals of each of the incandescent cathodes 6*a* and 6*b*. The other terminals of the incandescent cathodes 5*b* and 6*b* are connected to a line 17. The other terminals of the incandescent cathodes 5*a* and 6*a* are respectively connected to lines 18*a* and 18*b*. Dependent upon whether a filament current is supplied to the incandescent cathode 5*a* or 5*b* via the lines 16*a* and 18*a* or 17, or to the incandescent cathode 6*a* or 6*b* via the lines 16*b* and 18*b* or 17, an electron beam emanates from the incandescent cathode 5*a*, 5*b*, 6*a* or 6*b*. The electron beam emanating from the respectively activated incandescent cathode 5*a*, 5*b*, 6*a* or 6*b* is incident on a target 19 of the anode dish 10, as indicated with broken lines in FIG. 1. The electron beam emanating from the incandescent cathode 5*a* is incident at a first focal spot BF1A, the electron beam emanating from the incandescent cathode 5*b* is incident at a second focal spot BF1B, the electron beam emanating from the incandescent cathode 6*a* is incident at a third focal spot BF2A and the electron beam emanating from the incandescent cathode 6*b* is incident at a fourth focal spot BF2B. As a consequence of the rotation of the anode dish 10, annular focal spot paths BFB1A, BFB1B, BFB2A and BFB2B are formed on the target 19 during operation of the x-ray tube. These paths have different radii and do not overlap one another.

The anode dish 10 is composed of different materials, at least in the region of its target 19. The target is divided into two annular regions 10 and 21 and is composed of ruthenium or tungsten in the region 20 on which the focal spot paths BFB1A and BFB1B belonging to the incandescent cathodes 5*a* and 5*b* are located. The target 19 is composed of molybdenum in that region 21 wherein the focal spot paths BFB2A and BFB2B belonging to the incandescent cathodes 6*a* and 6*b* are located. It is adequate for the respective material to be provided in a layer thickness that is at least equal to the penetration depth of the electrons emanating from the respective incandescent cathode 5*a*, 5*b*, 6*a* or 6*b*.

Thus x-radiation having a first hardness is generated upon activation of one of the incandescent cathodes 5*a* or 5*b*, this hardness corresponding to the characteristic radiation of ruthenium or tungsten. When one of the incandescent cathodes 6*a* or 6*b* is activated, x-radiation having a second hardness that corresponds to the characteristic radiation of molybdenum is generated.

A single beam exit window 24, which, for example, can be formed of beryllium, is provided for the x-radiation emanating from the focal spots BF1A, BF1B, BF2A or BF2B.

Figure 3:
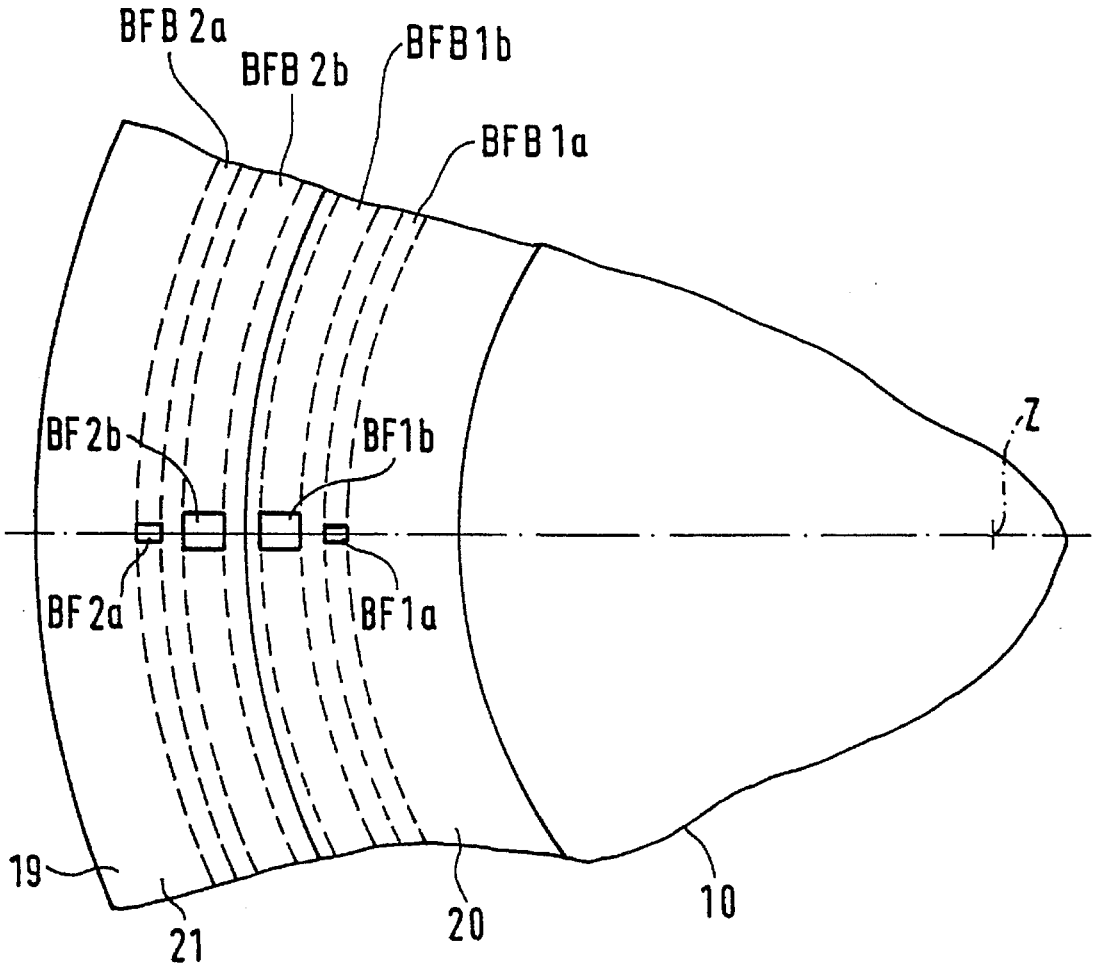
FIG. 3 is a front view of that region of the target of the rotating anode of the x-ray tube of FIGS. 1 and 2 that lied opposite the cathode arrangement.

The employment of a single beam exit window 24 is possible because the focal spots BF1A, BF1B, BF2A and BF2B lie at least approximately on a straight line intersecting the circumferential direction of the anode dish 10, this straight line being entered dot-dashed in FIG. 3 and proceeding at least essentially radially. As a result of this measure, an arrangement of the focal spots BF1A, BF1B, BF2A and BF2B lying extremely close to one another is achieved, as can be seen in FIG. 3. The center of the anode dish 10 is referenced Z in FIG. 3.

The incandescent cathodes 5*a* and 5*b* as well as 6*a* and 6*b* are accepted in a common, straight-line focusing channel 25 of the concentration cup 4, whereby the incandescent cathodes 5*a* and 6*b* are smaller than the incandescent cathodes 5*b* and 6*b* and are arranged at the outer ends of the focusing channel 25. Consequently, the focal spots BF1A and BF2A are smaller than the focal spots BF1B and BF2B as can be seen in FIG. 3.

As a consequence of the described arrangement of the incandescent cathodes 5*a*, 5*b*, 6*a* and 6*b* in the focusing channel 25, the two larger focal spots BF1B and BF2B are immediately adjacent to one another.

The x-ray tube has a control unit 22 allocated to it which generates all voltages and currents required for the operation of the x-ray tube and which also controls the switching of the focal spots. The switching of the focal spots can be accomplished by an operator by actuation of a switch 23 connected to the control unit 22, this switch 23 having an appropriately identified switch position for each of the focal spots. The switching can alternatively ensue automatically, for example dependent on control elements with which the physical constitution (thick/thin) of the examination subject is entered, or dependent on the distance between the focal spot and the x-ray film, or the distance between the x-ray film and the subject which has/have been set. These factors determine the magnification factor for an exposure.

The exemplary embodiment refers to an x-ray tube whose target is divided into two regions formed of different material. More than two regions of different material, however, can be provided.

In the described exemplary embodiment, two focal spots are generated in each of the regions of the target 19. There is also the possibility within the context of the invention of using a cathode and a control unit having the capability of generating a plurality of focal spots in one region, generating a plurality of focal spots in each of the regions, or generating only one focal spot in selectable individual regions (with the capability of simultaneously selecting more than one region under certain circumstances). The focal spots of a region can thereby have different sizes and/or positions.

The x-ray tube has been set forth above in the context of a rotating anode x-ray tube. The invention, however, can also be employed in x-ray tubes having a stationary anode.

In the case of the described exemplary embodiment, the electron emitter is formed by directly heated incandescent cathodes that generate electron beams incident at the respective focal spot on the target. Instead of incandescent cathodes, however, other electron emitters, for example indirectly heated cathodes or electron beam guns, can be employed. If directly heated incandescent cathodes are employed as electron emitters, these need not necessarily be fashioned as wire helices as in the case of the described exemplary embodiment. Serpentine strip emitters as disclosed, for example, in German OS 27 27 907 can alternatively be employed.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray tube comprising:

an anode having a target area divided into a plurality of regions, said regions respectively consisting of different materials; and electron emitter means for generating at least one focal spot in each of said region and a plurality of focal spots of respectively different sizes in at least one of said regions, said emitter means generating said focal spots in said different regions and said focal spots of different sizes in said one region in close proximity for obtaining a focal position which is substantially the same for all of said focal spots.

2. An x-ray tube as claimed in claim 1 wherein said anode comprises an anode dish, and further comprising means for rotating said anode dish, and wherein said electron emitter means comprises means for generating said focal spots at respectively different radii of said anode dish.

3. An x-ray tube as claimed in claim 2 wherein said anode dish, when rotated by said means for rotating, exhibits a circumferential direction, and wherein said electron emitter means comprises means for generating said focal spots substantially along a straight line intersecting said circumferential direction.

4. An x-ray tube as claimed in claim 3 wherein said electron emitter means comprises means for generating said focal spots substantially along a straight line proceeding substantially radially on said anode dish and intersecting said circumferential direction.

5. An x-ray tube as claimed in claim 1 wherein said electron emitter means comprises means for generating at least one large focal spot and at least one small focal spot in two of said regions, and for generating said respective large focal spots in said two of said regions immediately adjacent to each other.

6. An x-ray tube as claimed in claim 1 wherein said anode comprises an anode divided into two regions consisting of different materials.

7. An x-ray tube as claimed in claim 1 wherein said electron emitter means comprises means for generating a focal spot selectively in each of said regions.

8. An x-ray tube as claimed in claim 1 further comprising a common beam exit window for all of said focal spots.

9. A method for operating an x-ray tube having an anode with a target area divided into a plurality of regions consisting of different materials, said method comprising the steps of:

generating at least one focal spot in each of said regions;

generating a plurality of focal spots of respectively different sizes in at least one of said regions; and generating said focal spots in said different regions and said focal spots of different sizes in said one of said regions in close proximity for obtaining a focal position which is substantially the same for all of said focal spots.

10. A method as claimed in claim 9 comprising the additional steps of:

rotating said anode; and generating said focal spots on respectively different radii of the rotating anode.

11. A method as claimed in claim 10 wherein the rotating anode exhibits a circumferential direction, and comprising the additional step of generating said focal spots substantially along a straight line intersecting said circumferential direction.

12. A method as claimed in claim 11 wherein the step of generating said focal spots substantially along a straight line is further defined by generating said focal spots substantially along a straight line proceeding radially on said anode.

13. A method as claimed in claim 9 comprising the additional steps of:

generating at least one large focal spot and at least one small focal spot in two of said regions; and generating the respective large focal spots in said two of said regions immediately adjacent to each other.

14. A method as claimed in claim 1 wherein the step of generating at least one focal spot in each of said regions is further defined by selectively generating at least one focal spot in each of said regions.

* * * * *